US006883483B1

(12) United States Patent
Knudsen et al.

(10) Patent No.: US 6,883,483 B1
(45) Date of Patent: Apr. 26, 2005

(54) GASKET WITH PUSHROD RETAINER

(75) Inventors: Julian R. Knudsen, North Prairie, WI (US); Christopher B. Welch, Waukesha, WI (US)

(73) Assignee: Dresser, Inc., Addison, TX (US)

( * ) Notice: Subject to any disclaimer, the term of this patent is extended or adjusted under 35 U.S.C. 154(b) by 0 days.

(21) Appl. No.: 10/718,431

(22) Filed: Nov. 20, 2003

(51) Int. Cl.[7] ..... F01M 9/10

(52) U.S. Cl. ..... 123/90.37; 123/90.38; 123/90.61; 123/193.5; 123/195 A; 123/198 E; 74/18; 74/18.2; 29/464; 29/466; 428/66.4; 277/591; 277/598; 277/609; 277/616; 277/627

(58) Field of Search ..... 123/90.37, 90.38, 123/90.61, 193.1, 193.3, 193.5, 188.14, 195 R, 123/195 A, 198 E; 74/18–18.2; 29/888.01, 29/888.3, 888.46, 464, 466; 277/590–598, 277/608, 609, 616, 626, 627; 428/66.4

(56) References Cited

U.S. PATENT DOCUMENTS

| | | | | |
|---|---|---|---|---|
| 3,086,507 A | | 4/1963 | Mooney, Jr. | 123/90 |
| 4,453,505 A | | 6/1984 | Holtzberg et al. | 123/90.61 |
| 4,538,560 A | * | 9/1985 | Alden | 123/90.38 |
| 4,601,267 A | | 7/1986 | Kronich | 123/90.33 |
| 4,828,275 A | * | 5/1989 | Udagawa | 277/596 |
| 4,881,496 A | | 11/1989 | Kronich | 123/90.33 |
| 5,044,329 A | | 9/1991 | Jamora | 123/90.61 |
| 5,069,173 A | | 12/1991 | Mallas | 123/90.61 |
| 5,105,777 A | | 4/1992 | Kronich et al. | 123/193.3 |
| 5,150,910 A | * | 9/1992 | Udagawa | 277/592 |
| 5,642,701 A | | 7/1997 | Oswald et al. | 123/193.5 |
| 5,724,732 A | | 3/1998 | Arnold et al. | 29/888.01 |
| 6,237,557 B1 | * | 5/2001 | Wiegert | 123/193.5 |
| 6,299,175 B1 | * | 10/2001 | Maekawa et al. | 277/593 |

* cited by examiner

*Primary Examiner*—Thomas Denion
*Assistant Examiner*—Kyle M. Riddle
(74) *Attorney, Agent, or Firm*—Fish & Richardson P.C.

(57) ABSTRACT

In an engine having a rocker member adapted to rock about an axis intermediate the rocker member and a pushrod extending from a lower body to an upper body and engaging an end of the rocker member, a gasket for sealing the lower body to the upper body is provided. The gasket includes a sealing portion adapted to substantially seal at least a portion of the upper body to the lower body, and a pushrod support portion extending outwardly from the sealing portion adapted to engage the pushrod. At least a portion of the pushrod support portion engaging the pushrod is constructed from a material that is softer than the material of the pushrod.

31 Claims, 3 Drawing Sheets

GASKET WITH PUSHROD RETAINER

The U.S. Government has a paid-up license in this invention and the right in limited circumstances to require the patent owner to license other on reasonable terms as provided for by the terms of DE-FC02-01CH11080 awarded by the Department of Energy.

TECHNICAL FIELD

This invention relates to engines utilizing pushrods to operate its valves, and more particularly to a system and method for aligning the pushrod during assembly.

BACKGROUND

In an engine that utilizes pushrods to operate its valves, the pushrods are usually captured between an end of a rocker and a cam follower or lifter. The rocker and lifter position the pushrod both axially and laterally for operation in the engine, and the passages in the head and block through which the pushrod passes are loose about the pushrod. When the rocker is absent, for example prior to assembly with the head or when the rocker has been otherwise removed, the pushrod is not held in position and falls to the side of the passage. Thus, during assembly of the rocker to the head, the pushrods must be supported in alignment with the end of the rocker.

Supporting the pushrods in alignment with the end of the rocker during assembly of the rocker to the head is often times difficult. Access to the pushrods is limited by the other components adjacent the pushrods as well as the body of the head or rocker box itself. In addition to the difficulty in accessing the pushrods, installing the rockers while supporting the pushrods requires a high level of dexterity. Several tasks, including supporting the pushrods, engaging the pushrods with the end of the rocker, positioning the rocker in the rocker box, engaging the opposing end of the rocker with the valve or valve cap, and initially threading any bolts that hold the rocker in place, must be performed concurrently. The assembly becomes more difficult as the size of the engine increases, because the parts become larger, heavier, and more difficult to manipulate.

Therefore, there is a need for a device and its method of use that simplifies assembly of the rockers and pushrods.

SUMMARY

The invention is drawn to a device for supporting the pushrods in relation to the rocker and a method of assembling the engine in a manner that supports the pushrods in relation to the rocker.

One illustrative embodiment is drawn to a gasket for sealing a lower body of an engine to an upper body of the engine. The engine has a rocker member adapted to rock about an axis intermediate the rocker member and a pushrod extending from the lower body to the upper body and engaging an end of the rocker member. The gasket includes a sealing portion adapted to substantially seal at least a portion of the upper body to the lower body, and a pushrod support portion extending outwardly from the sealing portion adapted to engage the pushrod. At least a portion of the pushrod support portion engaging the pushrod is constructed from a material that is softer than the material of the pushrod.

Another illustrative embodiment is drawn to an engine having one or more valves operated by a pushrod. The engine includes an engine block assembly and a head mounted on the engine block assembly. The head at least partially receives the pushrod and the one or more valves. An upper body is mounted on the head. A gasket is between the head and the upper body. The gasket has a sealing portion adapted to substantially seal the upper body to the head and a pushrod supporting tab extending outward from the sealing portion and engaging the pushrod. At least a portion of the pushrod supporting tab engaging the pushrod is adapted to wear away when the engine is operated.

Yet another illustrative embodiment is drawn to a method of assembling a portion of an engine assembly. The method includes placing a gasket having pushrod engaging member on a lower engine body. The pushrod engaging member is adapted to wear away during operation of the engine. An elongate pushrod is placed in the engine body and in abutting engagement with the pushrod engaging member of the gasket. The elongate pushing member is thereafter supported substantially perpendicular to a longitudinal axis of the elongate pushing member with the gasket.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
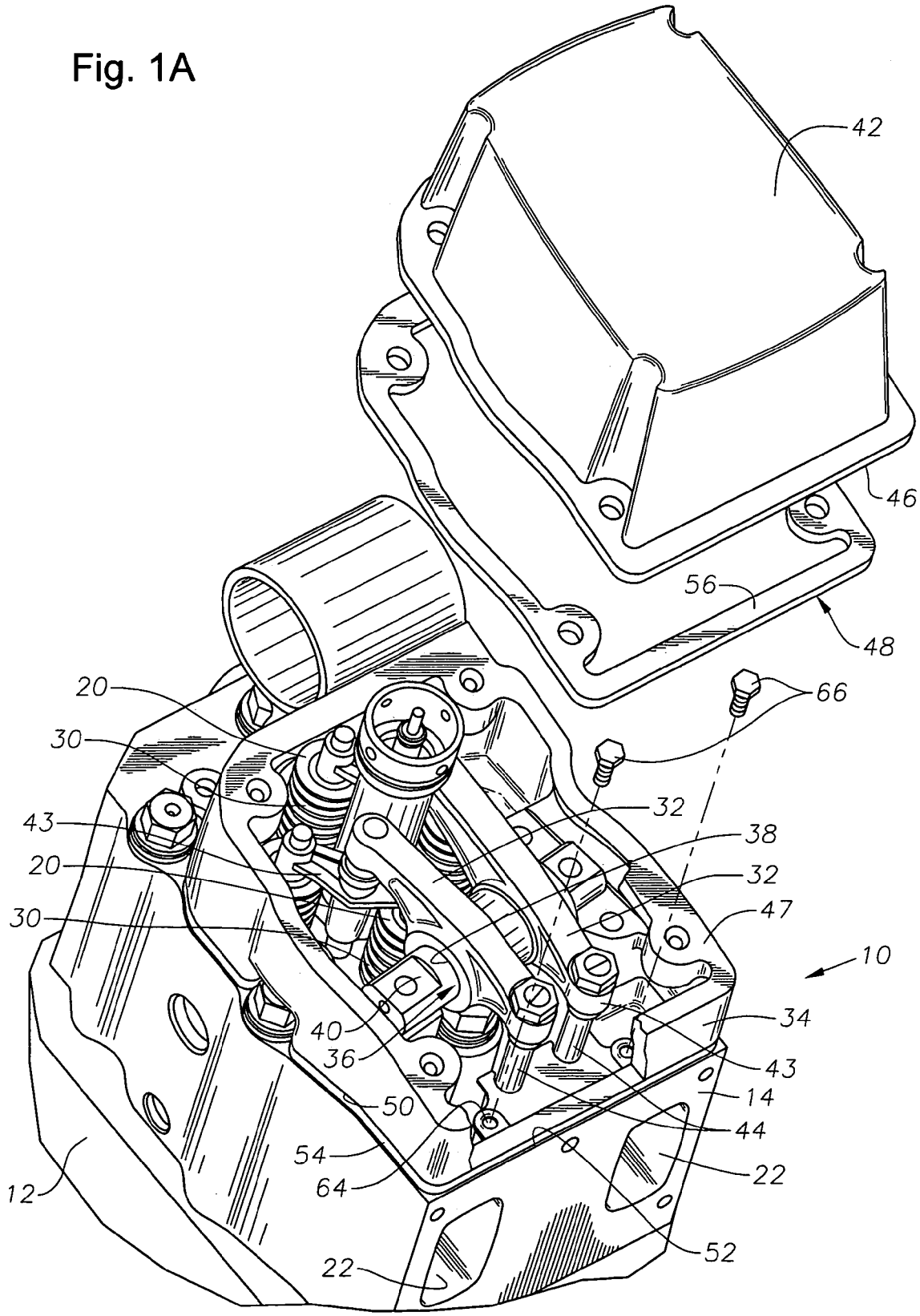
FIG. 1A is a partial exploded perspective view of an engine having a lower rocker box gasket with a pushrod supporting tab in accordance with the invention.
Figure 1B:
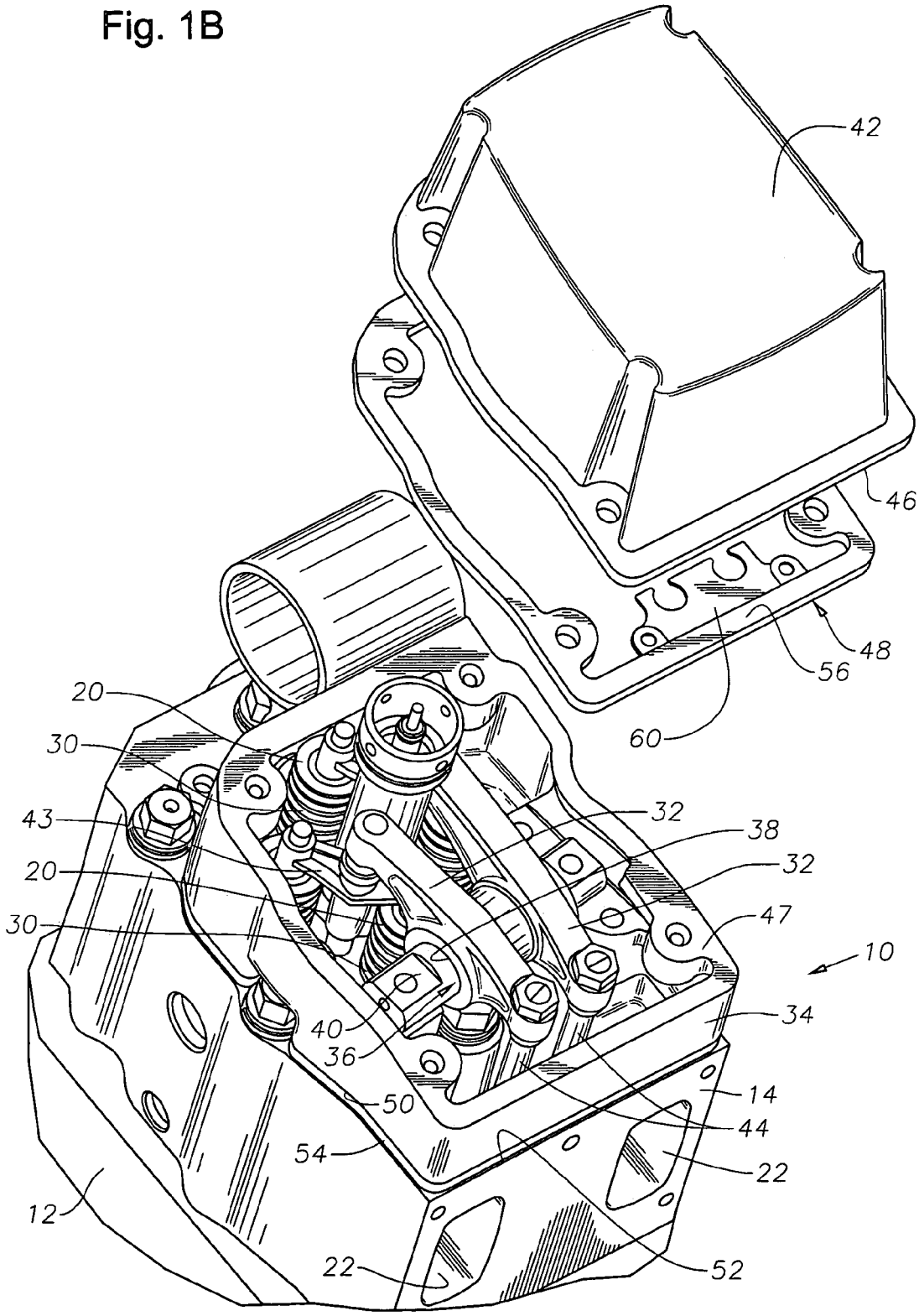
FIG. 1B is a partial exploded perspective view of an engine having a valve cover gasket with a pushrod supporting tab in accordance with the invention.

Referring first to FIGS. 1A and 1B, in an illustrative embodiment constructed in accordance with the invention an engine 10 comprises a block 12 and a head 14. The head 14 includes one or more linearly reciprocating valves 20 that reside at least partially within a corresponding number of inlet and exit ports 22 in communication with an interior of the engine 10, for example a combustion chamber. The valves 20 operate to control flow of fluid through inlet and exit ports 22 into the interior of the engine 10. The valves 20 substantially linearly reciprocate between an open position allowing flow between their respective port 22 and the interior of the engine 10 and a closed position preventing flow between their respective port 22 and the interior of the engine 10. In the illustrative embodiments of FIGS. 1A and 1B, the valves 20 are closed when in an uppermost position and open when in a lower most position. Springs 30 are provided with each valve 20 to bias the valve to a closed position.

The valves 20 are translated between an open and closed position by one or more rockers 32 pivotably carried by a rocker box 34 of the head 14. The rocker box 34 may be integral with the head 14 or may be a separate piece affixed to the head 14. A rocker 32 has a pivot 36 intermediate its ends that is adapted to enable the rocker 32 to rock in at least one plane with respect to the head 14. In the illustrative embodiments of FIGS. 1A and 1B, the pivot 36 comprises a cylindrical bore 38 in the rocker 32 that receives a cylindrical axle 40 supported by the rocker box 34. A rocker box cover or valve cover 42 mounts to the rocker box 34 to substantially enclose the valves 20 and rockers 32 within the rocker box 34.

Figure 3:
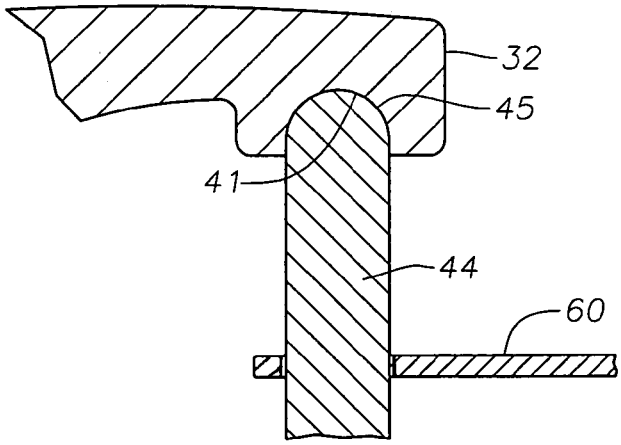
FIG. 3 is a cross sectional detail of a rocker and pushrod.

One end of the rocker 32 is configured to act on an end of the valve 20. In the illustrative embodiments of FIGS. 1A and 1B, the rocker 32 acts on the valve 20 through a valve cap 43 on an end of two adjacent valves 20, thereby depressing two valves 20 substantially simultaneously. The rocker 32, however, may act directly on one valve 20 or through a valve cap 43 that engages any number of valves 20. The opposing end of the rocker 32 is adapted to engage an elongate pushrod 44 extending upward through the head 14. The engagement of the rocker 32 to the pushrod 44 is of a type that provides lateral support to the end of the pushrod 44 while allowing relative angular movement between the rocker 32 and the pushrod. In the illustrative embodiment of FIG. 3, the end of the rocker 32 has a spherical profile 41 that mates with a corresponding spherical profile 45 on the end of the pushrod 44. The spherical profile 41 can be either a male or a female profile, and the corresponding spherical profile 45 is then the opposite gender. It is important to note, however, that other configurations of rockers 32 and pushrods 44 are within the scope of the invention.

The pushrod 44 is coupled to a cam, such as through a follower of lifter (not specifically shown) that reciprocates the pushrod 44 substantially coincident with the pushrod's longitudinal axis. The pushrod 44, rocker 32 and valve 20 are arranged such that movement of the pushrod 44 toward the end of the rocker 32 causes the rocker 32 to rock toward the valve 20, act against the valve 20, and translate the valve 20 to an open position. Thereafter, movement of the pushrod 44 away from the rocker 32 allows the rocker 32 to rock away from the valve 20. The spring 30 biases the valve 20 closed and rocks the rocker 32 back toward the pushrod 44.

When assembled, the pushrods 44 are laterally and axially restrained between the cam and the rockers 32. However, prior to assembly with the rocker 32, the pushrods 44 can move about laterally in the head and/or rocker box. During assembly, each pushrod 44 must be aligned to an end of the rocker 32 and held in position as the rocker 32 is attached to the rocker box 34. The upper surface of the rocker box 34 defines an upper seal surface 47 that substantially circumscribes a perimeter of the rocker box 34 and mates with a corresponding valve cover seal surface 46 on the valve cover 42. A valve cover gasket 48 is provided between the valve cover seal surface 46 and the upper seal surface 47, and has a seal portion 56 that substantially circumscribes the upper seal surface 47. The seal portion 56 is compliant to substantially seal against passage of fluids, such as oil and engine coolant, between the rocker box 34 and valve cover 42. If the rocker box 34 is not integral with the head 14, the lower surface of the rocker box 34 defines a lower seal surface 50 that substantially circumscribes a perimeter of the rocker box 34 and mates with a corresponding head seal surface 52 on the head 14. A lower rocker box gasket 54 is provided between the lower seal surface 50 and the head seal surface 52, and has a seal portion 58 that substantially circumscribes the lower seal surface 50. The seal portion 58 is compliant to substantially seal against passage of fluids, such as oil and coolant, between the rocker box 34 and the head 14.

The temperatures and pressures that the lower rocker box gasket 54 and valve cover gasket 48 must withstand are relatively low as compared to other engine gaskets in the vicinity, for example, a typical head gasket (not specifically shown) that seals a head to an engine block. A head gasket must withstand high combustion temperatures in the range of 1300 deg C. (2370 deg F.) and combustion pressures in the range of 14,000 kPa (2000 psi), and is quite different than a lower rocker box gasket 54 or valve cover gasket 48 that are typically subject to temperatures and pressures, for example, less than 175 deg C. (350 deg F.) and 700 kPa (100 psi). Accordingly, the lower rocker box gasket 54 and valve cover gasket 48 can be made from various materials, such as polymer materials (ex. rubber, silicone, aramid) and cellulose (ex. cork, paper), that allow the gasket to be soft and flexible unlike a head gasket. In some situations, the polymer or cellulose materials are deposited on a metal carrier, such as steel, aluminum, or copper. In contrast, a head gasket has sealing surfaces that are generally hard and stiff such as metal (steel, aluminum, or copper) or graphite.

Figure 2:
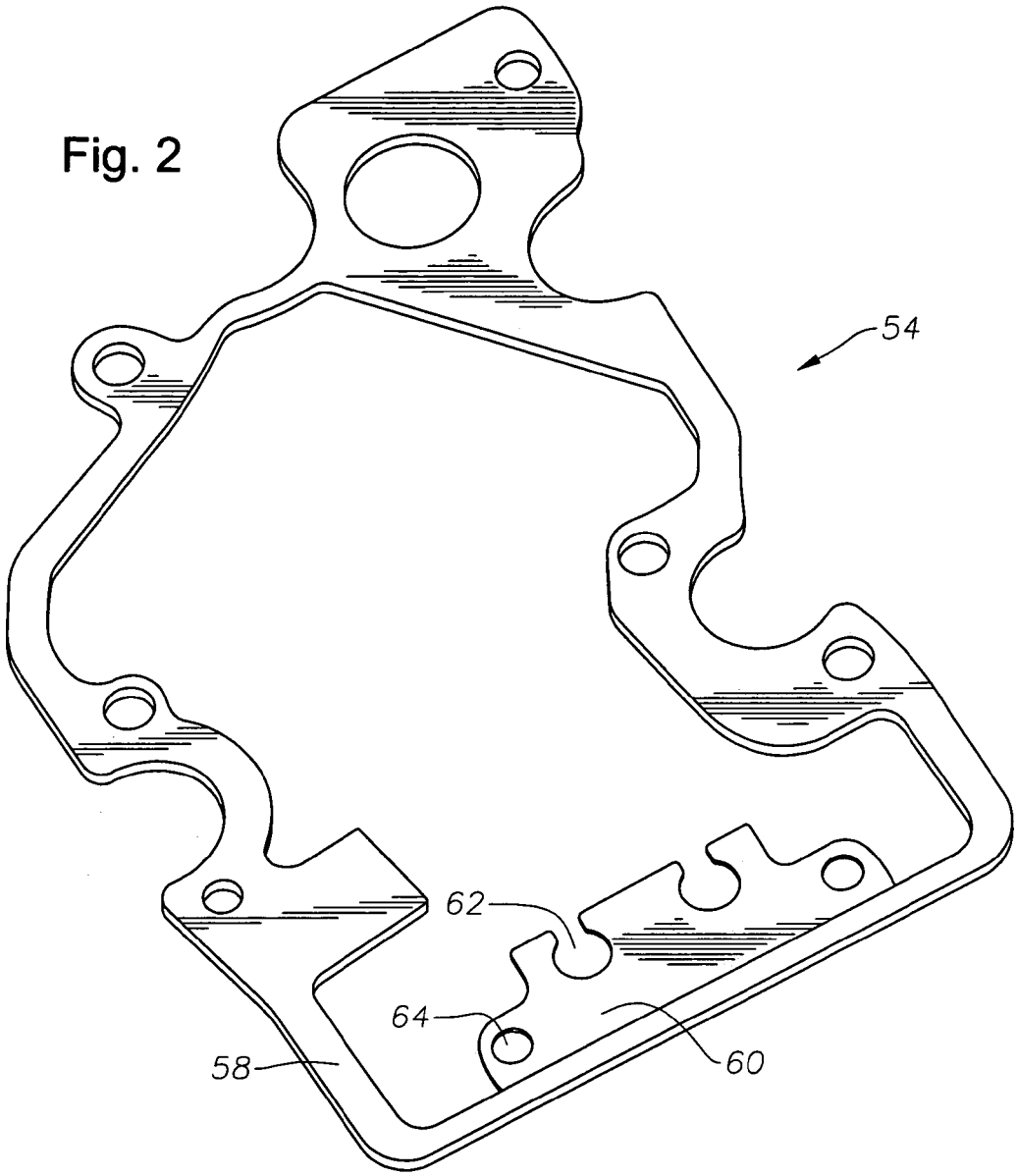
FIG. 2 is a plan view of the lower rocker box gasket of the present invention.

At least one of the lower rocker box gasket 54 or valve cover gasket 48 is provided with one or more pushrod supporting tabs 60, best seen in FIG. 2 in the context of a rocker box gasket 54. The pushrod supporting tab 60 is substantially planar and substantially coplanar with the adjacent sealing portions 56 and 58 of the gaskets 48 and 54. The pushrod supporting tab 60 extends outward from the sealing portions 56 or 58 and into engagement with at least one pushrod 44 (FIG. 1A). Such engagement laterally supports the pushrod 44 in alignment, or alternatively in rough alignment, with the end of the rocker 32, and if the rocker 32 is not yet in position, in a position to readily engage the end of the rocker 32 without further substantial alignment. For example, in an embodiment that utilizes mating spherical profiles 41 and 45 (FIG. 3), the engagement of the pushrod 44 by the pushrod supporting tab 60 can laterally support the pushrod 44 relative to the rocker 32 in such a manner that a center of the spherical profile 45 is within one radius of the spherical profile 41 from a center of the spherical profile 41 enabling the spherical profiles 41 and 45 to achieve any additional fine alignment necessary as the rocker 32 is installed.

In the illustrative embodiment of FIGS. 1A and 1B, the tab 60 engages two pushrods 44 simultaneously. Pushrod supporting tabs 60 may be provided to support all of the pushrods 44 in an engine 10, or fewer than all of the pushrods 44 in an engine 10. The pushrod supporting tab 60 may also be provided with one or more openings 64 to receive a supporting stub or fastener 66 (FIG. 1A) inboard from the sealing portion 56, 58 and carried by the head 14 or rocker box 34. The supporting stub or fastener 66 inserts through the opening 64 and supports the tab 60 in a desired orientation relative to the rocker box 34. In the illustrative embodiment of FIG. 1A, the supporting stub or fastener 66 supports the pushrod supporting tab 60 substantially perpendicular to a longitudinal axis of the pushrods 44. By providing the openings 64 and supporting stub or fasteners 66, the pushrod supporting tabs 60 can cantilever out from the gasket and be attached to the sealing portion 56 or 58 only along one edge. If desired, the openings 64 and supporting stub or fastener 66 can be omitted.

The pushrod supporting tab 60 can engage the pushrod 44 in various manners. For example, the engagement can be merely abutting engagement that laterally supports the pushrod 44 or the supporting tab 60 can be provided with an aperture 62 configured to receive the pushrod 44 and support the pushrod 44 laterally. In the illustrative embodiment of FIGS. 1A and 1B, the aperture 62 is C-shaped to receive the pushrod 44 through the opening in the C-shape and thereafter at least partially encircle and laterally support the pushrod 44. The aperture 62 need not be C-shaped or encircle a portion of the pushrod 44, and can be other various shapes that provide lateral support to the pushrod 44, such as a complete circular aperture, a notch, recess, or otherwise.

The supporting tab 60 can be comprised of substantially the same material as the sealing portion 56 or 58, or the supporting tab 60 can alternately or additionally include a different material. The different material may be less flexible than the material of the sealing portions 56 or 58 to provide rigidity to the supporting tab 60. For example, the supporting tab 60 may be a metal carrier with polymer material deposited or formed on its exterior or may have a polymeric bushing inserted into opening 62. At least a portion of the material engaging the pushrod 44, such as in aperture 62, can be a much softer material than the material of the pushrod 44 it contacts. Thus, for example, a pushrod 44 is typically made from hardened steel or aluminum and at least a portion of the supporting tab 60 that engages the pushrod 44 can be made from a much softer material such as the polymer or cellulose material of the sealing portion 56 or 58. The softer material can be selected to relatively quickly deteriorate or wear away (by movement of the pushrod 44) when the engine is operated without affecting or causing premature wear to the pushrod 44 at the point of engagement. With such softer material, additional hardening or anodizing of the pushrods 44 is unnecessary. In the example of a metal pushrod 44, polymer or cellulose material would quickly wear when the engine is operated without affecting or causing premature wear to the pushrod 44.

As an alternative to providing softer material that deteriorates or wears away, or in combination with such softer material, one or more of the apertures 62 can be sized so that the pushrod 44 engages the interior of the aperture 62 until the pushrod 44 further aligned by installation of the rocker 32. When engaged by the rocker 32, the pushrod 44 is supported in the interior of the aperture 62 and is free to move in its normal range of movement without substantial contact to the interior of the aperture 62 or the supporting tab 60. The normal range of movement of the pushrod 44 in the illustrative embodiment herein includes reciprocating movement along the pushrod's 44 longitudinal axis, as well as, some lateral movement induced by the rocking movement of the rocker 32.

Utilizing a lower rocker box gasket 54 or valve cover gasket 48 having a pushrod supporting tab 60 facilitates assembly of the engine 10. After installation of the head 14 to the block 12, the lower rocker box gasket 54 can be placed on the head 14 and the rocker box 34 affixed to the head 14. The pushrods 44 are inserted through the head 14 to couple with the cam, and are engaged by the pushrod supporting tab 60 of the lower rocker box gasket 54 to support the pushrods 44. In the case of C-shaped apertures 62, the pushrods 44 are received through the opening in the C-shape to be substantially encircled by the aperture 52. If no rocker box gasket 54 is used, for example with a rocker box 34 that is integral with the head 14, or the rocker box gasket 54 is not provided with a pushrod supporting tab 60, a valve cover gasket 48 with a pushrod supporting tab 60 is installed on the rocker box 34 and the pushrods 44 are engaged by the pushrod supporting tab 60 of the valve cover gasket 48. In either case, the pushrods 44 are supported in position to readily engage the end of their respective rockers 32. The rockers 32 can then be installed without providing substantial further support or alignment to the pushrods 44, and the pushrods 44 will be supported by the cam follower or lifter and the rockers 32. During operation of the engine 10, the pushrod supporting tab 60 may deteriorate or wear, but because the pushrods 44 are laterally supported between the cam follower or lifters and the rockers 32, the support provided by the pushrod supporting tabs 60 is unnecessary. Further, by providing at least a portion of the pushrod supporting tab 60 that engages the pushrod 44 made of a material that is softer than the material of the pushrod 44, the pushrod supporting tab 60 will not affect or cause premature wear to the pushrods 44.

A number of embodiments of the invention have been described. Nevertheless, it will be understood that various modifications may be made without departing from the spirit and scope of the invention. Accordingly, other embodiments are within the scope of the following claims.

What is claimed is:

1. A gasket for sealing a lower body of an engine to an upper body of the engine, the engine having a rocker member adapted to rock about an axis intermediate the rocker member and a pushrod, the rocker member located in the upper body, the pushrod extending from the lower body to the upper body and engaging an end of the rocker member, the gasket comprising:

a sealing portion adapted to substantially seal at least a portion of the upper body to the lower body;

a pushrod support portion extending outwardly from the sealing portion adapted to engage the pushrod, at least a portion of the pushrod support portion engaging the pushrod is constructed from a material that is softer than the material of the pushrod; and wherein the upper body comprises a rocker box and the lower body comprises a head and the sealing portion is adapted to substantially seal at least a portion of the rocker box to the head.

2. The gasket of claim 1 wherein at least a portion of the pushrod support portion engaging the pushrod comprises a material selected from the group consisting of a polymer and cellulose.

3. The gasket of claim 2 wherein the pushrod is constructed from a material comprising metal.

4. The gasket of claim 1 wherein the sealing portion comprises substantially the same material as the pushrod support portion.

5. The gasket of claim 1 wherein the pushrod support portion further comprises an aperture adapted to receive the pushrod and substantially support the pushrod in relation to the pushrod support portion.

6. The gasket of claim 5 further including polymeric materials deposited on a metallic gasket.

7. A gasket for sealing a lower body of an engine to an upper body of the engine, the engine having a rocker member adapted to rock about an axis intermediate the rocker member and a pushrod, the rocker member located in the upper body, the pushrod extending from the lower body to the upper body and engaging an end of the rocker member, the gasket comprising:

a sealing portion adapted to substantially seal at least a portion of the upper body to the lower body;

a pushrod support portion extending outwardly from the sealing portion adapted to engage the pushrod at least a portion of the pushrod support portion engaging the pushrod is constructed from a material that is softer than the material of the pushrod; and wherein the upper body comprises a valve cover and the lower body comprises a head and the sealing portion is adapted to substantially seal at least a portion of the valve cover to the head.

8. A gasket for sealing a lower body of an engine to an upper body of the engine, the engine having a rocker member adapted to rock about an axis intermediate the rocker member and a pushrod, the rocker member located in the upper body, the pushrod extending from the lower body to the upper body and engaging an end of the rocker member, the gasket comprising:

a sealing portion adapted to substantially seal at least a portion of the upper body to the lower body;

a pushrod support portion extending outwardly from the sealing portion adapted to engage the pushrod, at least a portion of the pushrod support portion engaging the pushrod is constructed from a material that is softer than the material of the pushrod; and wherein the pushrod support portion further comprises a substantially C-shaped opening adapted to receive the pushrod and substantially support against lateral movement of the pushrod.

9. The gasket of claim 8 further including a polymeric material formed on a metallic gasket.

10. An engine having one or more valves operated by a pushrod, comprising:

an engine block assembly;

a head mounted on the engine block assembly, the head at least partially receiving the pushrod and the one or more valves, an upper body mounted on the head;

a gasket between the head and the upper body, the gasket having a sealing portion adapted to substantially seal the upper body to the head and a pushrod supporting tab extending outward from the sealing portion and engaging the pushrod, at least a portion of the pushrod supporting tab engaging the pushrod is adapted to wear away when the engine is operated; and wherein the upper body is a valve cover.

11. An engine having one or more valves operated by a pushrod, comprising:

an engine block assembly;

a head mounted on the engine block assembly, the head at least partially receiving the pushrod and the one or more valves;

an upper body mounted on the head;

a gasket between the head and the upper body, the gasket having a sealing portion adapted to substantially seal the upper body to the head and a pushrod supporting tab extending outward from the sealing portion and engaging the pushrod, at least a portion of the pushrod supporting tab engaging the pushrod is adapted to wear away when the engine is operated; and wherein the upper body is a rocker box.

12. The engine of claim 11 wherein the pushrod comprises metal and the gasket comprises at least one of a polymer material and a cellulosic material.

13. The engine of claim 11 wherein the gasket and pushrod supporting tab comprise a polymer material.

14. The engine of claim 11 further comprising tab supporting members carried by the head adapted to support the pushrod supporting tab substantially perpendicular to a longitudinal axis of the pushrod.

15. A method of assembling a portion of an engine assembly, comprising:

placing a gasket having pushrod engaging member on a lower engine body, the pushrod engaging member adapted to wear away during operation of the engine;

placing an elongate pushrod in the engine body and in abutting engagement with the pushrod engaging member of the gasket;

supporting the elongate pushrod substantially perpendicular to a longitudinal axis of the elongate pushrod with the gasket; and wherein the lower engine member is an engine head.

16. The method of claim 15 further comprising inserting the pushrod into a pushrod engaging aperture of the pushrod engaging member.

17. The method of claim 15 further comprising installing a rocker that receives the pushrod at one end to the engine body without further substantially aligning the rocker and the pushrod.

18. A method of assembling a portion of an engine assembly, comprising:

placing a gasket having pushrod engaging member on a lower engine body, the pushrod engaging member adapted to wear away during operation of the engine;

placing an elongate pushrod in the engine body and in abutting engagement with the pushrod engaging member of the gasket;

supporting the elongate pushrod substantially perpendicular to a longitudinal axis of the elongate pushrod with the gasket; and wherein the pushrod comprises metal and at least a portion of the pushrod engaging member comprises at least one of a polymer and a cellulosic material.

19. A method of assembling a portion of an engine assembly, comprising:

placing a gasket having pushrod engaging member on a lower engine body, the pushrod engaging member adapted to wear away during operation of the engine;

placing an elongate pushrod in the engine body and in abutting engagement with the pushrod engaging member of the gasket;

supporting the elongate pushrod substantially perpendicular to a longitudinal axis of the elongate pushrod with the gasket; and further comprising supporting the pushrod engaging member on a support stub carried by the engine body.

20. A gasket for sealing a lower body of an engine to an upper body of the engine, the engine having a rocker member that engages a pushrod extending from the lower body to the upper body, the gasket comprising:

a sealing portion adapted to substantially seal at least a portion of the upper body to the lower body;

a pushrod support portion extending outwardly from the sealing portion adapted to engage and support the pushrod in rough alignment with an end of the rocker member prior to engaging the rocker member with the pushrod and adapted to reside out of substantial contact with the pushrod after engaging with the rocker member with the pushrod; and wherein the upper body comprises a rocker box and the lower body comprises a head and the sealing portion is adapted to substantially seal at least a portion of the rocker box to the head.

21. The gasket of claim 20 wherein at least a portion of the pushrod support portion engaging the pushrod comprises a material selected from the group consisting of a polymer and cellulose.

22. The gasket of claim 20 wherein the sealing portion comprises substantially the same material as the pushrod support portion.

23. The gasket of claim 20 wherein the pushrod support portion further comprises an aperture adapted to receive the pushrod and substantially support the pushrod in relation to the pushrod support portion.

24. The gasket of claim 20 wherein the at least a portion of the pushrod support portion engaging the pushrod is constructed from a material that is softer than the material of the pushrod.

25. A gasket for sealing a lower body of an engine to an upper body of the engine, the engine having a rocker member that engages a pushrod extending from the lower body to the upper body the gasket comprising:

a sealing portion adapted to substantially seal at least a portion of the upper body to the lower body;

a pushrod support portion extending outwardly from the sealing portion adapted to engage and support the pushrod in rough alignment with an end of the rocker member prior to engaging the rocker member with the pushrod and adapted to reside out of substantial contact with the pushrod after engaging with the rocker member with the pushrod; and wherein the upper body comprises a valve cover and the lower body comprises a head and the sealing portion is adapted to substantially seal at least a portion of the valve cover to the head.

26. A gasket for sealing a lower body of an engine to an upper body of the engine, the engine having a rocker member that engages a pushrod extending from the lower body to the upper body, the gasket comprising:

a sealing portion adapted to substantially seal at least a portion of the upper body to the lower body;

a pushrod support portion extending outwardly from the sealing portion adapted to engage and support the pushrod in rough alignment with an end of the rocker member prior to engaging the rocker member with the pushrod and adapted to reside out of substantial contact with the pushrod after engaging with the rocker member with the pushrod; and wherein the pushrod support portion further comprises a substantially C-shaped opening adapted to receive the pushrod and substantially support against lateral movement of the pushrod.

27. A method of assembling a portion of an engine assembly, comprising:

placing a gasket having pushrod engaging member on a lower engine body;

placing an elongate pushrod in the engine body and in abutting engagement with the pushrod engaging member of the gasket;

supporting the elongate pushrod substantially laterally to a longitudinal axis of the elongate pushrod member with the gasket;

engaging the elongate pushrod with a rocker member thereby moving the elongate pushing member substantially out of engagement with the gasket; and wherein the lower engine member is an engine head.

28. The method of claim 27 wherein the elongate pushrod comprises metal and at least a portion of the pushrod engaging member comprises at least one of a polymer and a cellulosic material.

29. The method of claim 27 further comprising inserting the elongate pushrod into a pushrod engaging aperture of the pushrod engaging member.

30. The method of claim 27 wherein engaging the pushrod with the rocker member comprises engaging the pushrod with the rocker member without further substantially aligning the rocker member and the elongate pushrod.

31. A method of assembling a portion of an engine assembly, comprising:

placing a gasket having pushrod engaging member on a lower engine body;

placing an elongate pushrod in the engine body and in abutting engagement with the pushrod engaging member of the gasket;

supporting the elongate pushrod substantially laterally to a longitudinal axis of the elongate pushrod member with the gasket; and engaging the elongate pushrod with a rocker member thereby moving the elongate pushing member substantially out of engagement with the gasket; and further comprising supporting the pushrod engaging member on a support stub carried by the engine body.

* * * * *